US005967287A

United States Patent [19]

Cole

[11] Patent Number: 5,967,287

[45] Date of Patent: Oct. 19, 1999

[54] INTERNALLY MOUNTED, EXTERNALLY LOCKABLE AND REMOVABLE COIN COMPARATOR MOUNTING DEVICE FOR VIDEO VENDING MACHINES AND THE LIKE

[76] Inventor: Joseph Cole, 4170-130 Distribution Cir., North Las Vegas, Nev. 89030

[21] Appl. No.: 09/007,880

[22] Filed: Jan. 15, 1998

[51] Int. Cl.[6] ..... G07F 1/02

[52] U.S. Cl. ..... 194/344; 194/350

[58] Field of Search ..... 194/215, 216, 194/217, 242, 244, 344, 350

[56] References Cited

U.S. PATENT DOCUMENTS

| | | | |
|---|---|---|---|
| 4,509,631 | 4/1985 | Kim | 194/350 |
| 4,546,868 | 10/1985 | Gregory, Jr. . | |
| 4,550,818 | 11/1985 | Holliday . | |
| 4,582,189 | 4/1986 | Schmitt . | |
| 4,629,051 | 12/1986 | Abe . | |
| 5,048,663 | 9/1991 | Abe . | |
| 5,165,511 | 11/1992 | Regidor | 194/350 X |
| 5,409,094 | 4/1995 | Muraco . | |
| 5,555,966 | 9/1996 | Tod . | |
| 5,609,234 | 3/1997 | Walker et al. . | |
| 5,662,204 | 9/1997 | Menke et al. | 194/215 |

*Primary Examiner*—F. J. Bartuska
*Attorney, Agent, or Firm*—Ben E. Lofstedt, Attorney

[57] ABSTRACT

An internally mounted, externally lockable and removable mounting device for a coin comparator for video vending machines and the like which allows for the ready installation, removal and alignment of a coin comparator to a coin track in a gaming/vending machine without requiring that the lid or the door to the gaming/vending machine cabinet be unlocked and opened to accomplish the installation, removal or alignment of the coin comparator.

11 Claims, 6 Drawing Sheets

INTERNALLY MOUNTED, EXTERNALLY LOCKABLE AND REMOVABLE COIN COMPARATOR MOUNTING DEVICE FOR VIDEO VENDING MACHINES AND THE LIKE

BACKGROUND OF THE INVENTION

1. Field of the Invention

This invention relates generally to a device and method for mounting, installing, removing, aligning and servicing a coin comparator within a video, vending, arcade or gaming machine and the like, and more specifically, to such a device pertaining to such machines having slant or bar-type lids or doors for access to the interior of the cabinets housing such machines.

2. Description of the Prior Art

Coin-operated video, vending, arcade or gaming machines employ the use of a coin comparator mechanism to determine whether the deposited coin is a genuine coin and is a coin of the proper denomination. A coin comparator typically consists of coin slot drop, and certain mechanical means for determining whether or not the coin deposited into the coin comparator is either acceptable or unacceptable. Once the coin is deposited into the coin slot portion of the coin comparator, the coin drops into the interior of the coin comparator. While in the coin comparator, the coin is compared against a pre-set or pre-determined set of coin standards and, following this comparison, the deposited coin is either accepted or is rejected as an unacceptable coin.

If the deposited coin is acceptable, the coin comparator mechanism will direct the coin into a money drop, sometimes referred to as a coin bowl. These acceptable coins are later retrieved by the owner of the machine, or, alternatively, if the machine is a gaming machine, in the event that the machine falls into a win for the player-customer, it will dispense one or more coins from the coin bowl into a coin hopper which is accessible to the player-customer for retrieval.

If the coin is not acceptable either because it is a counterfeit coin or a coin of the wrong denomination, the coin is rejected by the coin comparator and returned to a coin hopper accessible to the person who deposited the coin for retrieval.

In prior art coin-operated video gaming machines, the coin comparator is securely mounted inside a locked cabinet to prevent access thereto by unauthorized persons. However, occasionally the coin comparator will become jammed with one or more coins and must be cleared to allow it be operationally functional again. In prior art video games, the coin comparator was mounted by either securing it, or its mounting chassis, directly to the hinged lid or top door to the gaming machine cabinet, which hinged lid or top door is typically referred to as either a "slant" top or a "bar" top depending on whether it has an angle in it or if it is flat, or, alternatively, it is mounted to a support structure inside the locked cabinet not secured to the hinged lid or top of the cabinet.

In either of these prior art configurations, clearing a coin jam requires that the locked cabinet be first opened with a key to gain access to the coin comparator mechanism inside the cabinet. However, opening the locked cabinet is highly undesirable because with the opening of the gaming machine cabinet, the person clearing the coin jam in the coin comparator mechanism, typically has access also to the coin bowl where the deposited coins are held and stored inside the locked cabinet. Having access to the money inside the locked cabinet oftentimes results in loss or theft of the coins inside the cabinet or even theft, or intentional modification, or tampering, of the expensive electronics used in video gaming machines. Consequently, for these reasons, unlocking the cabinet is not desirable since such action compromises security.

Further, it is vitally important to ensure good alignment between the bezel, mounted on the user side of the machine, the coin comparator, mounted inside the lid or door and the coin-handling track which directs an accepted coin to the coin-holding hopper or directs the rejected coin to the coin bowl or coin return tray. Misalignment is an ever-present problem that when working with a relatively large size movable bar top or slant-top which moves with respect to the stationary coin comparator and coin-handling track mounted to the cabinet.

Still further, there exists a continuing and pressing need for ready access to the coin comparator in the event one or more coins becomes jammed inside the coin comparator.

Also, from time to time, it may be desirable to change the denomination of the coins for this coin-operated machine. To adapt the video gaming machine for use with a different coin denomination, replacement of the coin comparator with a coin comparator for a different coin denomination is required.

The means of mounting and aligning the comparator has been addressed by the prior art in several ways. The most common solution is to mount the comparator directly to the lid or door wherein the bracket which holds the comparator possess a tab which protrudes through the lid or door and provides means for alignment of the bezel. Adjustment is generally provided by means of elliptical slots. Typically, the coin comparator is mounted behind the coin hopper and is not readily accessible for service. Still another solution requires the comparator to be mounted in front of the coin hopper. This concept often leads to unusual geometry and requires the use of a larger size cabinet. The use of a larger size cabinet is not desirable because of the high cost of the floor space. Still further, another solution requires the coin comparator to be fixed within the main cabinet and to be separate from the lid. Alignment between the coin bezel and the coin comparator is generally achieved by allowing the bezel to float within its mounting frame and, once aligned, it is guided into place by means of a combination of pins in the bezel which are mated to complementary slots in the frame structure.

Still further, physical allowances must be made to position and align the coin track relative to the coin comparator.

While such prior art methods function to align the various components together, such methods are susceptible to movement when servicing the coin comparator or other mechanisms within the main cabinet.

Further, these prior art methods require access to the main cabinet and thereby provide for the opportunity for pilfering or tampering with the valuable electronics. If the valuable electronics are altered or stolen, the loss is very expensive in terms of both the cost to replace such lost electronics involved, but also due to the fact that the vending machine is not in operation and, as such, is losing revenue for it's owner.

Additionally, if the electronics are altered, it may result in excessive payouts causing the machine's owner to suffer a loss of revenue.

SUMMARY OF THE INVENTION AND OBJECTS

In accordance with the preferred embodiment of the invention described herein, the coin comparator and its mounting bracket are secured to a moveable slide. The slide is captured within a fixed bracket permanently mounted to the main cabinet. At the base of the moveable slide is a bolt which is threadably secured thereto via a threaded receptacle. This bolt limits the upward travel of the movable slide and when removed allows for the complete removal of the slide from the mounting bracket. The coin bezel, affixed to a bezel mounting plate, is secured to the movable slide. The bezel mounting plate also incorporates a lock to lockably secure the entire coin comparator and its mounting bracket to the lid, or to the top door, of the cabinet.

One primary and important object of the instant invention is to provide for the means of readily servicing the coin comparator either to unjam it or to change the denomination of the coins used with the video gaming or vending machine.

Another significant and primary objective of the present invention is to improve security when installing, removing or servicing the coin comparator mechanism.

A further important and primary object of the instant invention is to provide the means of readily aligning the bezel, comparator and coin-handling track while minimizing the interior space requirements within the cabinet.

A yet still further object of the invention is to reduce the potential of damaging the comparator or to prevent misalignment between the various components when the lid or deck is either opened or closed.

Another important and primary object of the invention is to allow for a simple means of changing the coin comparator to allow the denomination of the coins used in conjunction with the video gaming or vending machine to be changed.

A yet still further and important object of the invention is to substantially reduce the number of parts and tolerances between the parts.

BRIEF DESCRIPTION OF THE DRAWINGS

These and other objects and advantages of the invention will be apparent from reading the following description in conjunction with the drawings, in which.

DETAILED DESCRIPTION OF THE PREFERRED EMBODIMENT

Figure 1:
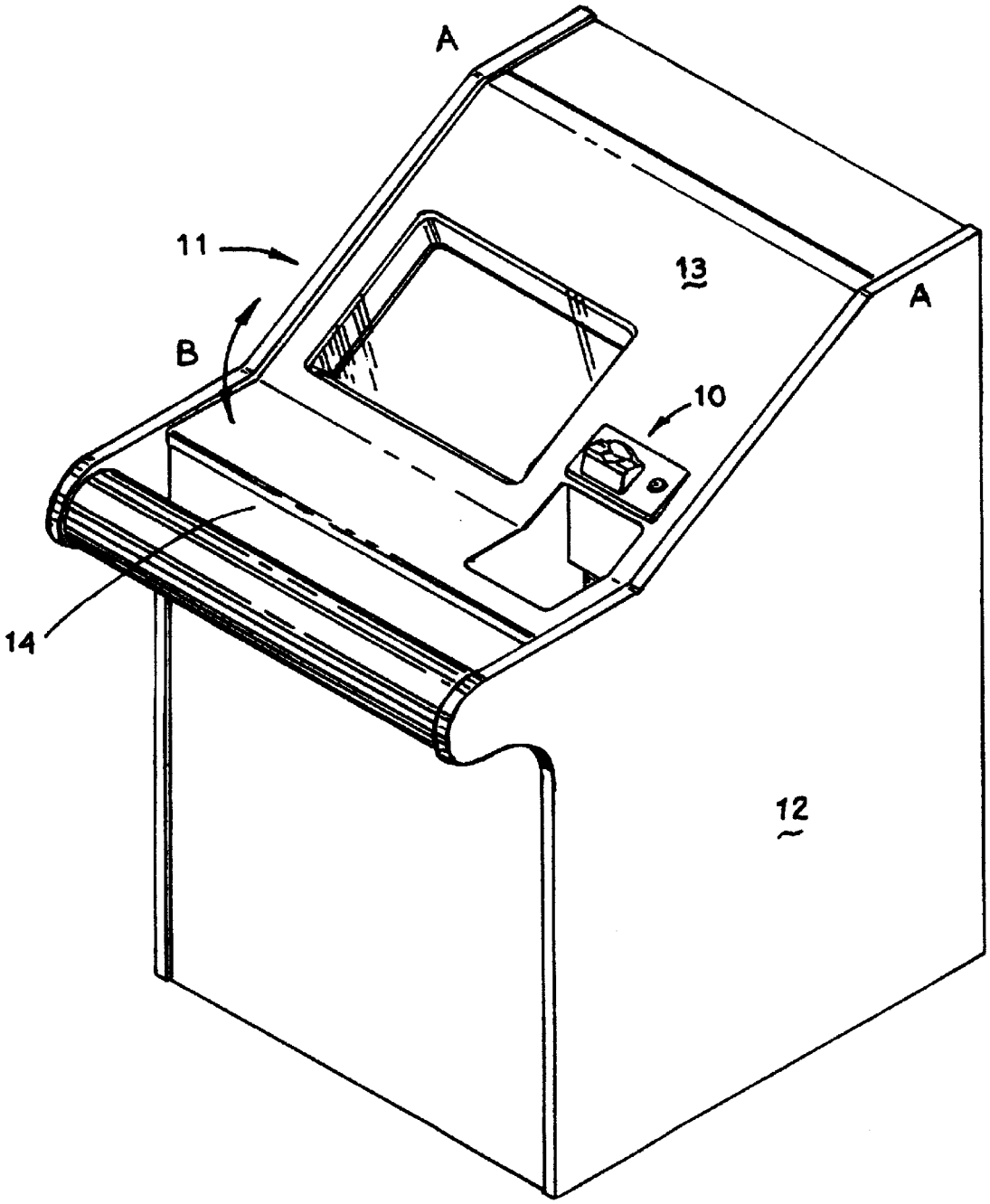
FIG. 1 is a perspective view of the subject invention described herein mounted in a slant-top free-standing cabinet.

With continuing reference now to all of the drawings herein, and with special emphasis and reference now to FIG. 1, the invention, an internally mounted, externally lockable and removable mounting device for coin comparator, generally referred to hereinafterwards as an improved coin mech mounting assembly generally indicated at 10, is illustrated installed in a slant-top type of video gaming or vending machine, generally shown at 11, mounted in a free-standing cabinet 12.

The slant-top 13 is typically secured to the cabinet 12 by a hinge (not shown) which pivots along axis A—A and moves back and forth as indicated by the bi-directional arrows at B. As illustrated in FIG. 1, the slant-top 13 is depicted in its normally-closed, ready-for-use-by-a-customer position. A key-operated lock (not shown) is used to lockably secure the unhinged, forwardmost end 14 of the slant-top 13 to the cabinet 12.

Figure 2:
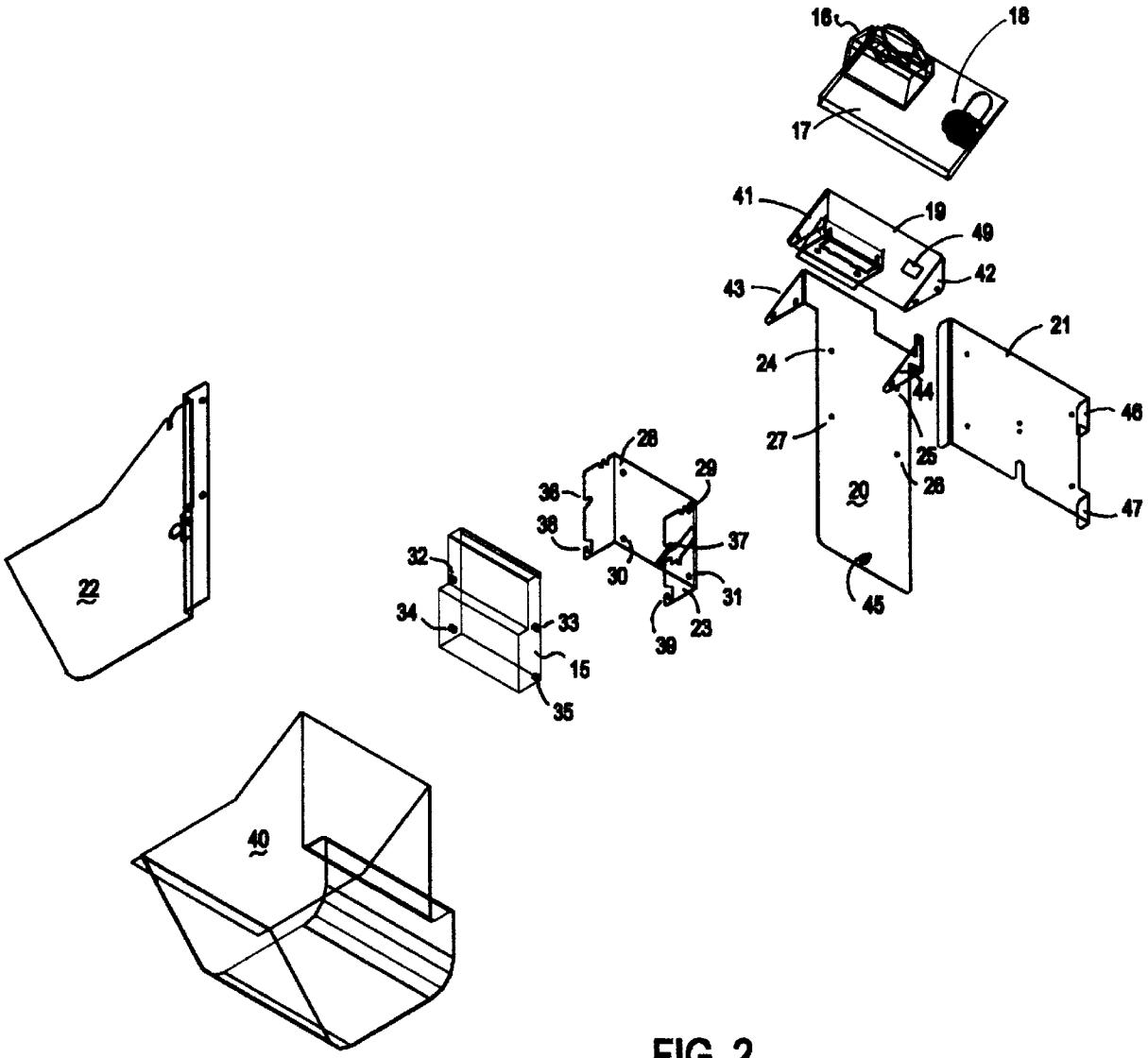
FIG. 2 is a perspectively arranged, exploded assembly view of the instant assembly illustrating the invention disclosed herein shown with the coin hopper and without the coin comparator.

With special emphasis now on FIG. 2, the invention, herein disclosed and described, is an improved security and service device for use with video game vending machines, and the like, consisting of an internally mounted, externally lockable and removable improved mounting device 10 for a coin comparator 15. This coin mech mounting device 10 allows for the external removal, installation and alignment of a coin comparator 15 in a gaming/vending machine cabinet 12 thereby eliminating the need to unlock the gaming/vending machine cabinet 12.

This improved coin mech mounting device, generally indicated at 10, comprises, the bezel mounting plate 17, a slide plate 20 to which the coin comparator 15 is removably interlockable via the mounting adapter 23 for the coin comparator 15, a locking mechanism 18 for locking the slide plate 20 to the top lid 13 cabinet 12, an adapter 19 for mounting the bezel mounting plate 17 to the slide plate 20, the main mounting bracket 21 which is utilized to act as both a support and a guide for the movement of the slide plate 20, and a coin hopper support bracket and side mounting plate 22 which is secured to the main mounting bracket 21.

The mounting adapter 23 for the coin comparator 15 is removably secured to the slide plate 20 via four (4) threaded fasteners (not shown) through the holes 24, 25, 26 and 27 in the slide plate 20 which are complementarily aligned with holes 28, 29, 30 and 31, respectively in the mounting adapter 23 for the coin comparator 15.

A double pair of locating pins 32, 33 and 34, 35 are mounted to the coin comparator 15 for locating and supporting the coin comparator 15 in the mounting adapter 23 via the complementary slots 36, 37, 38 and 39 which match up with locating pins 32, 33, 34 and 35 respectively.

The coin hopper 40 is shown in phantom lines in FIG. 2. If a coin is rejected by the coin comparator 15, the rejected coin is deposited into the coin hopper 40. In a video gaming machine 11, in the event of a win, coins are released from the coin bowl (not shown) and deposited into the coin hopper 40.

The ends 41, 42 of the adapter 19 for mounting the bezel mounting plate 17 to the slide plate 20 have a pair of holes therein for matching a pair of holes in the top mounting ears 43, 44 of the slide plate 20 for passing a double pair of threaded fasteners (not shown) therethrough to secure the adapter 19 to the slide plate 20.

A spring-loaded, return and lock latch 48 is operatively mounted to the side of the mounting adapter 23 for the coin comparator 15. This latch 48 operably engages the locating pin 33 which is mounted to the coin comparator 15 to lockably secure the coin comparator 15 in a relatively fixed position for operation and use.

OPERATION OF THE INVENTION

Figure 3:
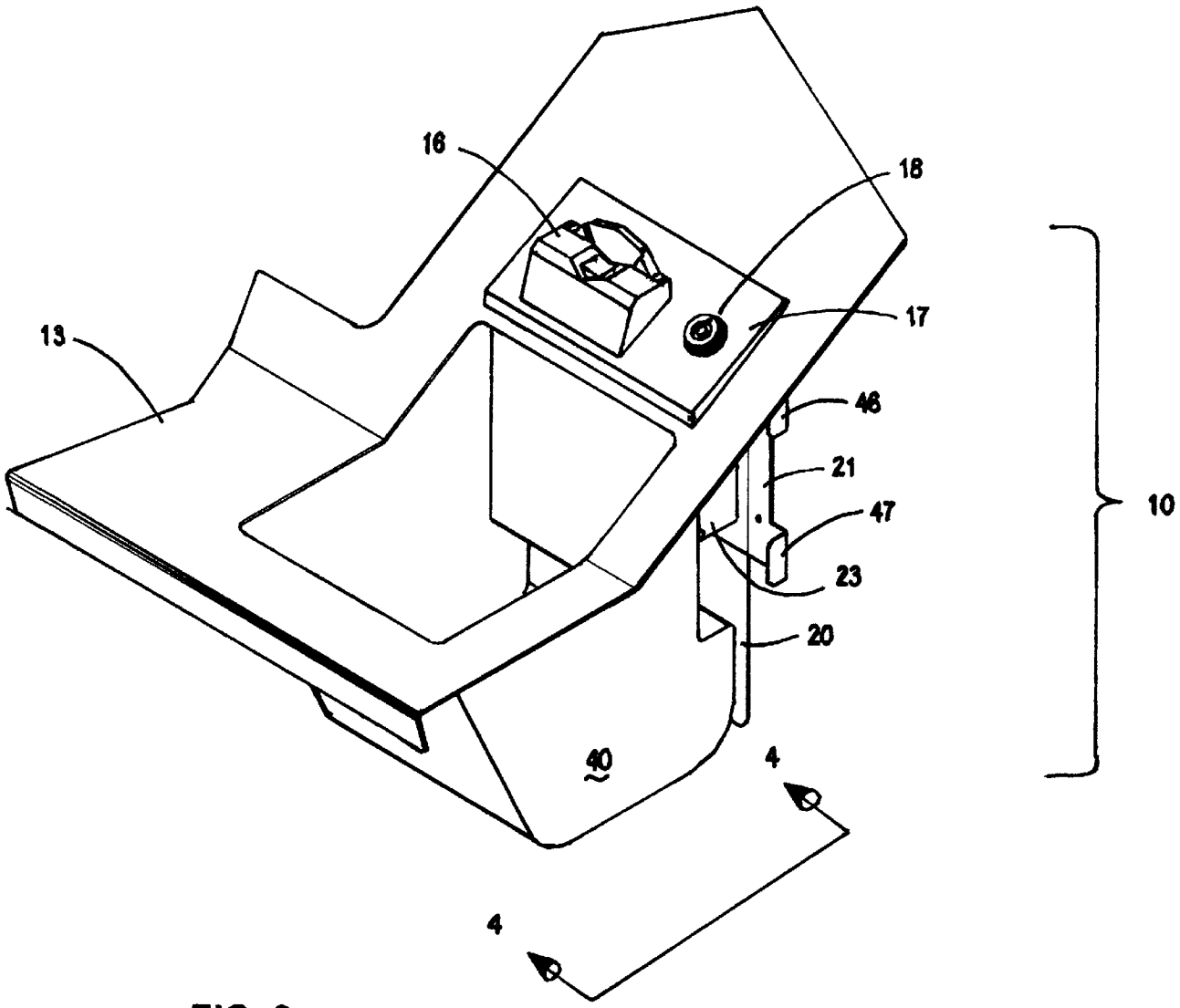
FIG. 3 is a perspective view of the coin mech system removed from the slant-top cabinet shown in its installed and normal operating position.
Figure 4:
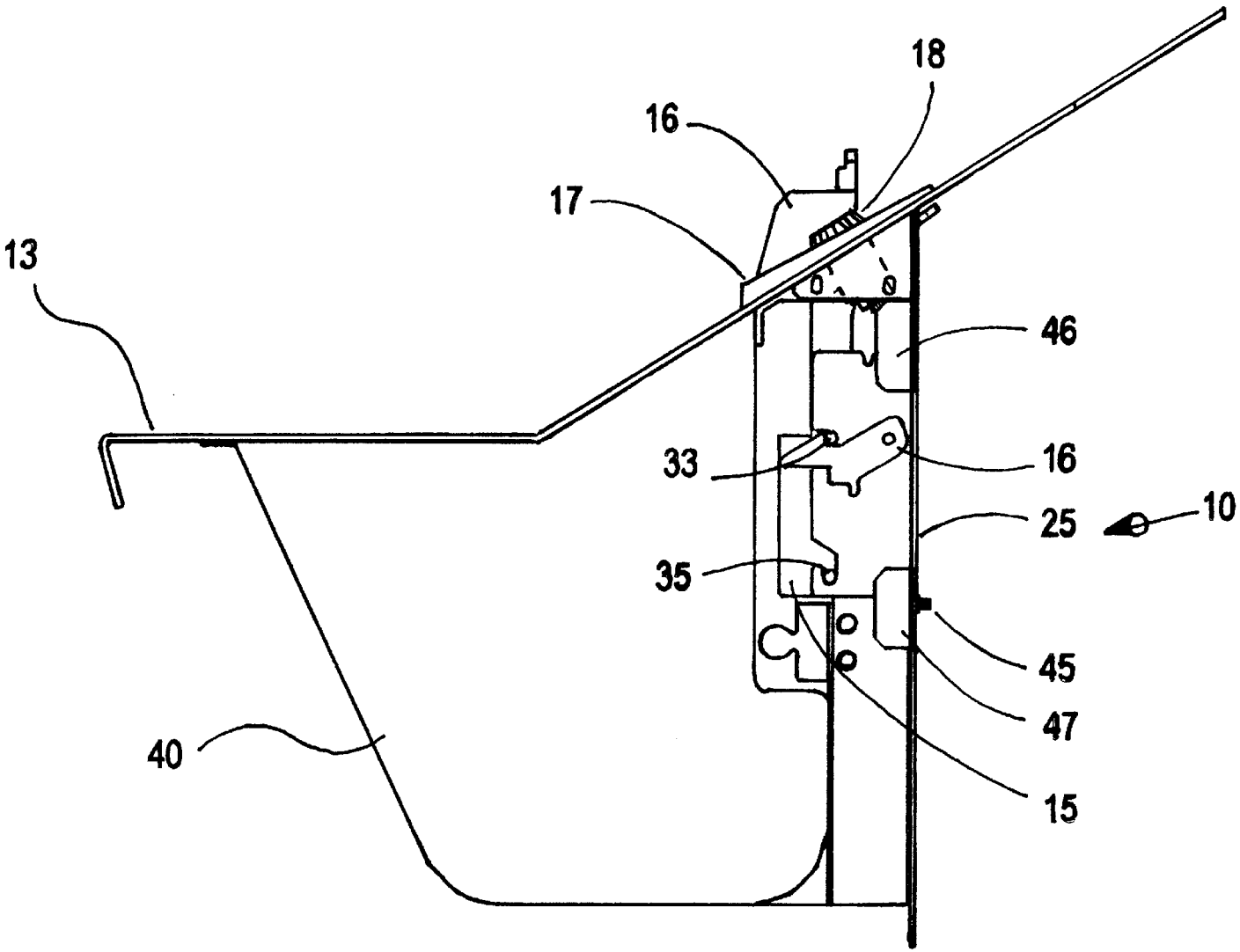
FIG. 4 is an elevational view of the coin mech system taken from the side view at 4—4 of FIG. 3 and depicting the coin comparator in its installed and normal operating position.

With continuing reference to all of the drawings herein, and with special emphasis now on FIGS. 3 and 4 of the drawings of a preferred embodiment of the invention disclosed herein, the invention at 10 is shown in it's installed or ready-to-be-used operational position.

Figure 5:
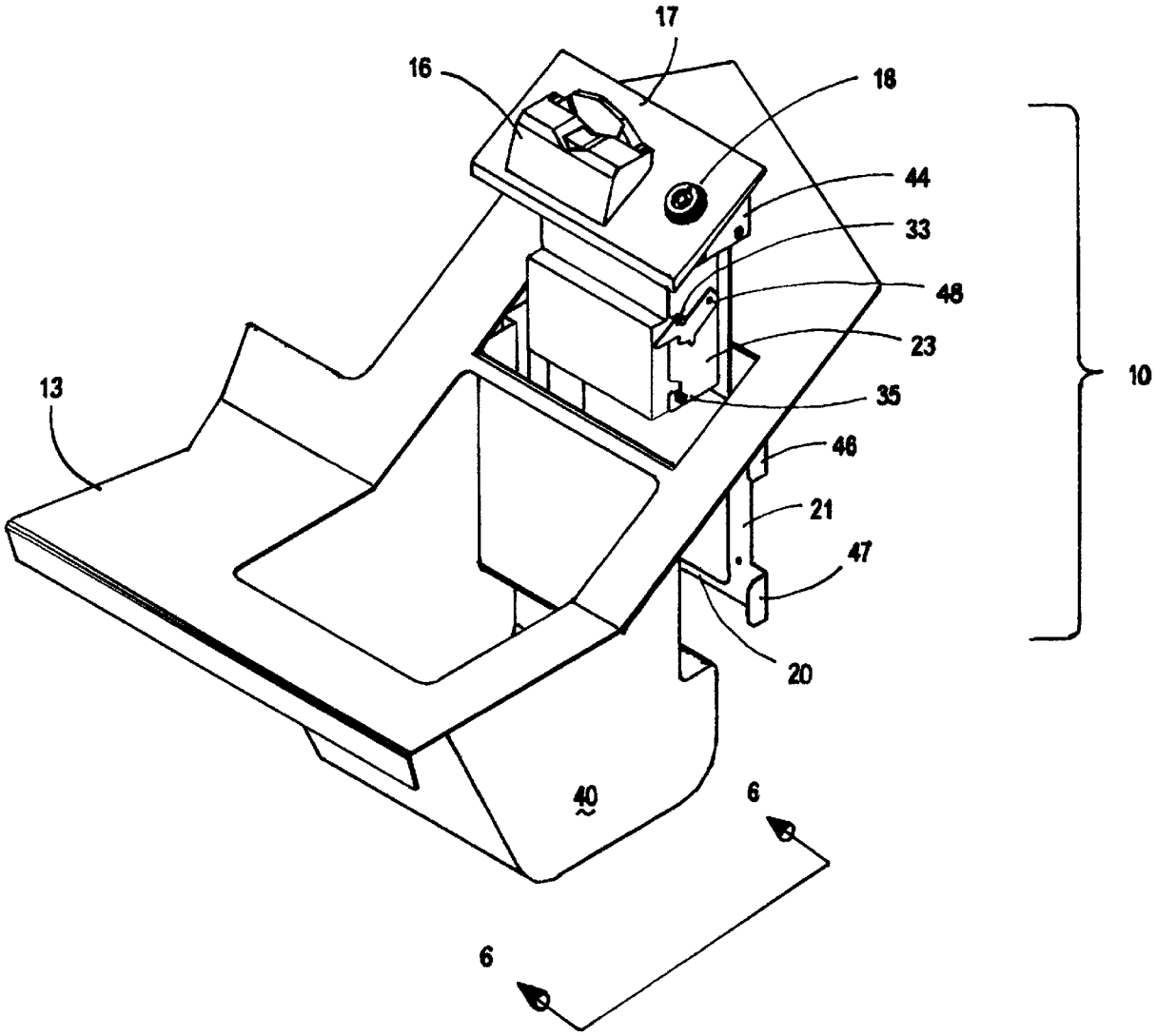
FIG. 5 is a perspective view of the coin mech system removed from the slant-top cabinet shown partially withdrawn from its normal operating position.
Figure 6:
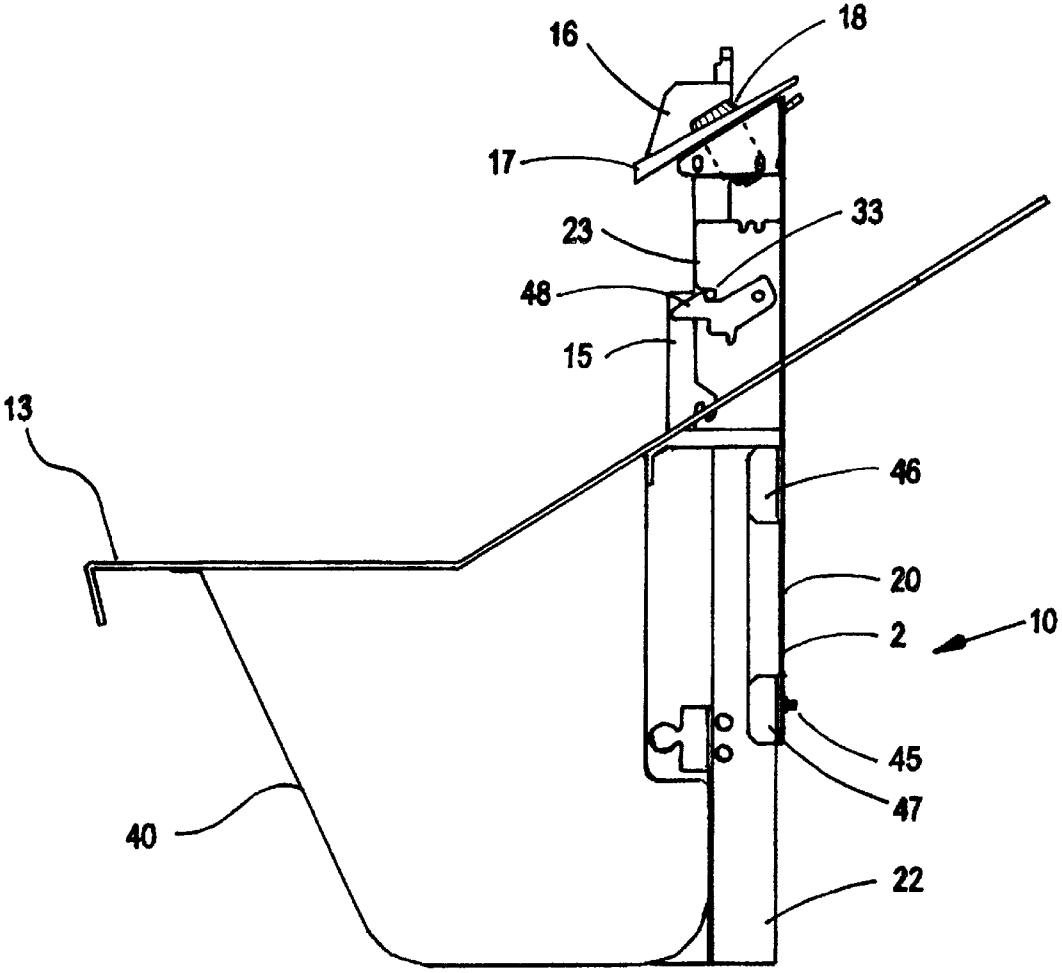
FIG. 6 is an elevational view of the coin mech system taken from the side view at 6—6 of FIG. 5 and depicting the coin comparator in a partially withdrawn, non-operating position.

FIGS. 5 and 6 of the drawings of a preferred embodiment of the invention disclosed herein, the invention at 10 is shown in a partially withdrawn position. This position depicts the invention at 10 transitioning from its removal from the cabinet 12 or its installation into the cabinet 12.

In order to move the invention 10 from its installed, ready-to-use position shown in FIGS. 3 and 4 of the drawings, a key is used to open the lock 18 mounted on the bezel mounting plate 17. With the lock 18 in its locked position, the bezel mounting plate 17 to which the lock 18 is mounted is effectively locked into the cabinet 12 and it cannot be withdrawn therefrom.

Once the lock 18 is opened, however, the bezel mounting plate 17, the adapter 19, and the slide plate 20 can be partially withdrawn from the cabinet 12. The degree to which the slide plate 20 can be withdrawn from the cabinet 12 is shown in FIGS. 5 and 6 and is determined by the stop pin 45 mounted on the slide plate 20 as shown in FIGS. 2, 4 and 6. By so limiting the degree to which the slide plate 20 can be withdrawn, security is maintained because access into the cabinet 12 and to various other mechanisms and the coin bowl is prevented. However, the degree of withdrawal is more than sufficient to allow access to the coin comparator 15 and to be able to remove the coin comparator 15 and to replace the coin comparator 15, as needed and/or desired.

Once the mechanism is in the partially withdrawn position depicted in FIGS. 5 and 6, the end of the latch 08 is manually depressed with the forefinger thereby disengaging the latch 48 from the pin 33. The top of the coin comparator 15 can then be pulled slightly forward to clear the bezel mounting plate 17 and thereafterwards be lifted out of the rest of the assembly.

Re-installation of the coin comparator 15 or installation of a new coin comparator 15 is very nearly the opposite of the removal process.

As is evident from the illustration of the invention described and disclosed herein, by virtue of the position of the coin comparator 15, that any coin which is rejected will be readily discharged into the coin hopper 40.

Additionally, it should be noted that the coin comparator 15 nests into the coin hopper 40 thereby reducing the amount of the normally required space within the gaming/vending machine cabinet 12.

When service is complete, the invention 10 is returned to its standard operating position and locked with the key-operated lock 18 to the cabinet 12. Once seated, alignment between the coin comparator 15 and coinhandling track (not shown) are re-established because only the coin comparator 15 is ever moved; everything else is never moved and, consequently, remains in alignment with the coinhandling track and the coin bezel 16.

It is to be understood that the form of the invention herewith shown and described is to be taken as a preferred example of the same and that various changes in shape, size and arrangement of parts may be resorted to, without departing from the spirit of the invention or the scope of the claims.

What I claim as my invention is:

1. An improved device for a mounting a coin comparator in the top of a cabinet housing a gaming/vending machine with a customer/player accessible coin hopper to allow removal and installation of the coin comparator without unlocking the cabinet housing of the gaming/vending machine, comprising:

(a) a coin bezel means for receiving coins;

(b) bezel mounting adapter plate means operably secured to said coin bezel means;

(c) support bracket means operably associated with said coin hopper;

(c) a first mounting bracket means for said coin comparator, said mounting bracket means operably secured to said support bracket means;

(d) a second mounting bracket means operably secured to said support bracket means;

(e) slider plate means operably secured in slidable relationship to said second mounting bracket means, said slider plate means being further operably secured in fixed relationship to said bezel mounting adapter plate means and said slider plate being further operably secured in fixed relationship to said first mounting bracket means for said coin comparator; and (e) locking means operably secured to the said bezel mounting plate means for locking said bezel mounting plate means to said cabinet housing to prevent withdrawal of the bezel mounting plate means from the cabinet housing.

2. The improved device of claim 1 further comprising latching means for operably holding said coin comparator in alignment with said first mounting bracket means.

3. The improved device of claim 1 further comprising release lever means for engaging and disengaging said coin comparator from said first mounting bracket means.

4. The improved device of claim 3 further comprising stop pin means for limiting the travel of said slider plate means.

5. The improved device of claim 4 wherein said stop pin means prevents the the full withdrawal of the slider plate means and said first mounting bracket means for said coin comparator.

6. The improved device of claim 1 wherein said coin bezel means and said bezel mounting adapter plate means are formed as a single unit.

7. An improved mounting device for a coin comparator in a gaming/vending machine with a coin hopper accessible to the customer/gamer to allow removal and installation of the coin comparator from the improved mounting device without unlocking a cabinet of the gaming/vending machine, comprising:

(a) a coin bezel means with a mounting plate formed therebeneath as an integral part thereof, said coin bezel means having a slot therein for passing coins therethrough, (b) a coin comparator operably disposed beneath the slot in said coin bezel means and mounting plate for receiving coins from said slot;

(c) a first mounting bracket means operably secured to said coin comparator;

(d) slide plate means operably secured to said first mounting bracket means;

(e) a second mounting bracket means operably secured to said mounting plate of said coin bezel and the upper portion of said slide plate means;

(f) locking means operably secured to said mounting plate of said coin bezel for locking said mounting plate to said cabinet;

(g) latching means operably secured to said first mounting bracket means for releaseably engaging and disengaging said coin comparator with and from said first mounting bracket means;

(f) a third mounting bracket means operably secured to said coin hopper, and said slide plate means to maintain alignment both during and after slideable movement of said slide plate means with respect thereto; and (g) stop pin means operably secured to the bottom portion of said slide plate means for limiting the travel of said slide plate means.

8. The improved device of claim 7 wherein said first mounting bracket means operably secured to said coin comparator is operably secured to a pair of oppositely-disposed sides of the coin comparator.

9. The improved device of claim 7 wherein said latching means operably secured to said first mounting bracket means for releaseably engaging and disengaging said coin comparator with and from said first mounting bracket means, consists of:

(a) a lever having a slotted portion in the edge thereof and pivotally mounted to a portion of the first mounting bracket means operably secured to one of said pair of oppositely-disposed sides of said coin comparator; and (b) a return spring means operably associated with said lever and said first mounting bracket.

10. The improved device of claim 7 wherein said coin comparator further comprises a double pair of complementary pins mounted on a pair of oppositely-disposed sides of said coin comparator.

11. The improved device of claim 10 wherein said first mounting bracket means includes a double pair of complementary slots alignably engageable with said double pair of complementary pins mounted on said pair of oppositely-disposed sides of said coin comparator to hold said coin comparator in fixed relationship thereto.

* * * * *